US010285492B2

(12) United States Patent
Soloff

(10) Patent No.: US 10,285,492 B2
(45) Date of Patent: May 14, 2019

(54) LATERAL SUPPORT BRUSH

(71) Applicant: Brandon Soloff, New York City, NY (US)

(72) Inventor: Brandon Soloff, New York City, NY (US)

( * ) Notice: Subject to any disclaimer, the term of this patent is extended or adjusted under 35 U.S.C. 154(b) by 666 days.

(21) Appl. No.: 14/868,664

(22) Filed: Sep. 29, 2015

(65) Prior Publication Data

US 2017/0086573 A1 Mar. 30, 2017

(51) Int. Cl.

| | |
|---|---|
| ***A46B 9/12*** | (2006.01) |
| ***A46B 5/02*** | (2006.01) |
| ***A46B 15/00*** | (2006.01) |
| ***A46D 99/00*** | (2006.01) |
| ***B25G 1/10*** | (2006.01) |
| ***A46B 9/02*** | (2006.01) |

(52) U.S. Cl.

CPC ..... *A46B 9/12* (2013.01); *A46B 5/02* (2013.01); *A46B 9/02* (2013.01); *A46B 15/0097* (2013.01); *A46D 99/00* (2013.01); *B25G 1/102* (2013.01); *A46B 2200/205* (2013.01)

(58) Field of Classification Search

CPC ..... A46D 99/00; B25G 1/102; A46B 9/12; A46B 5/02; A46B 9/02; A46B 15/0097

See application file for complete search history.

(56) References Cited

U.S. PATENT DOCUMENTS

| | | | | |
|---|---|---|---|---|
| D617,564 | S * | 6/2010 | Nanda | D4/112 |
| 9,227,231 | B2 * | 1/2016 | Rahbar-Dehghan | A46B 9/02 |
| D789,695 | S * | 6/2017 | Jain | D4/127 |
| 2007/0039109 | A1 * | 2/2007 | Nanda | A46B 5/00 15/105 |

* cited by examiner

*Primary Examiner* — Shay Karls

(74) *Attorney, Agent, or Firm* — Daniel Becker; Robert G. Rosenthal

(57) ABSTRACT

A paint brush comprises an elongate handle having a proximal end and a distal end, a tuft of bristles having properties according to at least two distinct directions, and a ferrule. The bristles are arranged substantially parallel to an axial direction and the cross section of the tuft of bristles is in a plane that has a width in a lateral direction. One end of the handle is operatively associated and is in substantially longitudinal alignment with the tuft and the ferrule is adapted to surroundingly encircle and connect said handle to said tuft of bristles so as to support the bristles against splaying in the lateral direction and limit deflection of the width.

10 Claims, 6 Drawing Sheets

LATERAL SUPPORT BRUSH

FIELD OF THE INVENTION

This invention relates generally to the field of brushes, paintbrushes, and more particularly to fine art paintbrushes where precise paint application is required.

BACKGROUND OF THE INVENTION

Brushes, and even fine art paintbrushes, have been in use for centuries as an ordinarily understood tool for applying various liquid and powder substances for surfaces, including adhesives and coatings and paints and cosmetics. Historically, bristles are the most common method of applying paint, as a tuft comprising a multitude of bristles can deflect as a single contact region to follow the face of a surface on which to apply paint, and scribe a track having a controllably consistent thickness and width. The spaces between the bristles provide a floating volume in which paint may be retained, such that evenly laid strokes may be longer and so that successive strokes may be made, without reapplying paint to the brush as often.

However, the bristles themselves also provide limitations. While bristles are able to deflect to follow a surface, they also push against one another as they deflect, and as a result, under many circumstances, such as a painter becoming fatigued against the effort of maintaining even stroke pressure, bristles may bend laterally away from the direction of application. As the bristles migrate laterally, the tuft of the bristles becomes wider, and strokes made by the brush widen and become inconsistent. This widening and loss of consistency is called splay. The problem which results from splay is that during use of a paintbrush experiencing splay, the wider and less consistent strokes cause paint to be deposited in unwanted areas on the work. This not only irritates an artist, as it then requires effort to remedy the error, but also, in extreme cases, can ruin the work beyond repair.

While the above is an example of splay arising from ordinary limitations of bristles during diminishing quality of control of the painter, another cause of splay arises cumulatively with respect to the lifetime fatiguing of the brush, rather than the painter. Paint which accumulates in the volumes within a tuft of bristles, and which dries in place, without being fully washed out, forces the bristles away from one another. This eventually results in splaying of the tuft of bristles, which progresses simply by cumulative ordinary use.

Yet another drawback of current paintbrushes is that ordinary brushes can be not-optimally balanced for a particular artist, which can cause fatigue. In typical paintbrushes of the art, the degree of imbalance is a function of a paint handle length (and weight), the ferrule, bristles, and the amount of paint on the bristles, relative to the ideal balance point for the painter. In the circumstance of fine art painting, artists will frequently paint using multiple paintbrushes. In such case, the problem is how to safely store said paint laden brushes while not in use, so as to not damage the bristles, and to avoid the transfer of paint to other brushes, as well as surfaces and objects that are not intended to receive paint."

In view of the foregoing, the present invention achieves an improved paintbrush according to the following objects.

An object of the present invention is to provide an improved paintbrush that has little to no bristle-splaying.

Still another object of the present invention is to provide an improved paintbrush with improved balance.

Yet another object of the present invention is to provide an improved paintbrush which can be easily retained in a manner that prevents transfer of paint between the brush and other brushes or surfaces.

SUMMARY OF THE INVENTION

To accomplish the objects described above, there is provided here a brush comprising an elongate handle having a proximal end and a distal end, a tuft of bristles having properties according to at least two distinct directions, and a ferrule. The bristles are arranged substantially parallel to an axial direction and the cross section of the tuft of bristles is in a plane that has a width in a lateral direction. One end of the handle is operatively-associated-with-and is in substantially-longitudinal-alignment-with-the tuft and the ferrule is adapted to surroundingly encircle and connect said handle to said tuft of bristles so as to support the bristles against splaying in the lateral direction and limit deflection of the width.

The brush provides an optimized balance by comprising a counterweight applied to the end of the brush which is opposite the end comprising the tuft of bristles, supporting a rearwardly-shifted balance or equilibrium point. The rearwardly shifted equilibrium point offers greater control to a painter having a regular preference of a grip in which the brush is held towards the back. The hand of such a painter that prefers a more rearward balance therefore has a lessened eccentric load about his hand, and therefore less fatigue. In addition to the benefit of decreased fatigue, a less tired hand makes easier strokes, and degradation of control is lessened. Degradation of control is a mode of error of mishandling a brush, such as to push a brush too forcefully toward a surface to be painted. Pushing a brush too forcefully is one source of compression of the tuft of bristles that results in splay. As a result, the counterbalance compounds the effectiveness of other antisplay features of the brush. To further shift rearward the equilibrium point, it is preferred to use a dowel like handle, which has a center of gravity further rearward than a handle which is tapered towards the front of the brush. Tapered handles are typical of the field of art, and the best mode of the present invention additionally differs from the prior art in this regard, by having a non-tapered handle.

The brush also provides greater lifetime resistance to splay by comprising a magnetic retaining element applied to the end of the brush which is opposite the end comprising the tuft of bristles. The magnetic element allows the brush to be retained to a magnetic surface. Where the magnetic surface is arranged such that the retainment of the brush may hold the brush at an angle optimized for drying, such as hanging invertedly or a position at which paint flows along the bristles evenly, even if not draining, such as standing vertically, the cumulative effect of drying-induced splay is minimized.

A further advantage of vertical retainment is that brushes are less likely to touch one another. Holding a brush vertically prevents transferring paint to another brush, as might happen when two brushes lay next to one another on the same surface. Also, vertical retainment decreases the risk of transferring paint to objects not meant to receive paint, such as a table or piece of clothing."

In pursuit of reduction to practice of the present invention, it was realized that the advantages achieved with respect to a preferred mode of brushes, fine art paint brushes, such brushes having various shapes, sizes, material composition, and effect during application, were equivalently applicable to brushes which are not limited to merely fine art painting.

The inventor recognizes that his invention would also have analogous use within fields of brushes wherein splay is detrimental, and contemplates embodiments having improved utility for types of brushes including at least brushes for adhesives, brushes for cosmetics, and brushes for coatings.

DETAILED DESCRIPTION OF THE PREFERRED EMBODIMENTS

The drawings depict some useful and novel embodiments of the present invention, but do not limit the present invention to any particular displayed embodiment.

Figure 1:
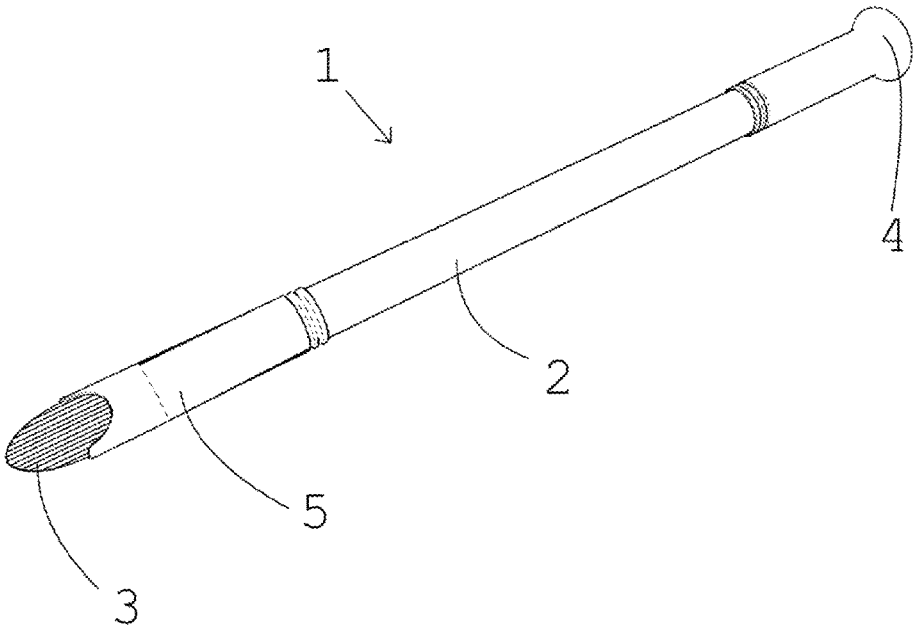
FIG. 1 shows an oblique view of a counterbalanced lateral support paintbrush embodiment of the present invention.

Referring now to FIG. 1, an embodiment of the present invention, a counterbalanced lateral support paintbrush (1), is shown. It has an elongate handle (2), with a tuft (3) of bristles at one end, and a counterbalancing weight (4) at the other end. A ferrule (5) connects the tuft (3) with the handle (2). In FIG. 1, the tuft (3) is a rounded tuft, an exemplary mode of tuft shape contemplated for the counterbalanced lateral support paintbrush (1).

Figure 2:
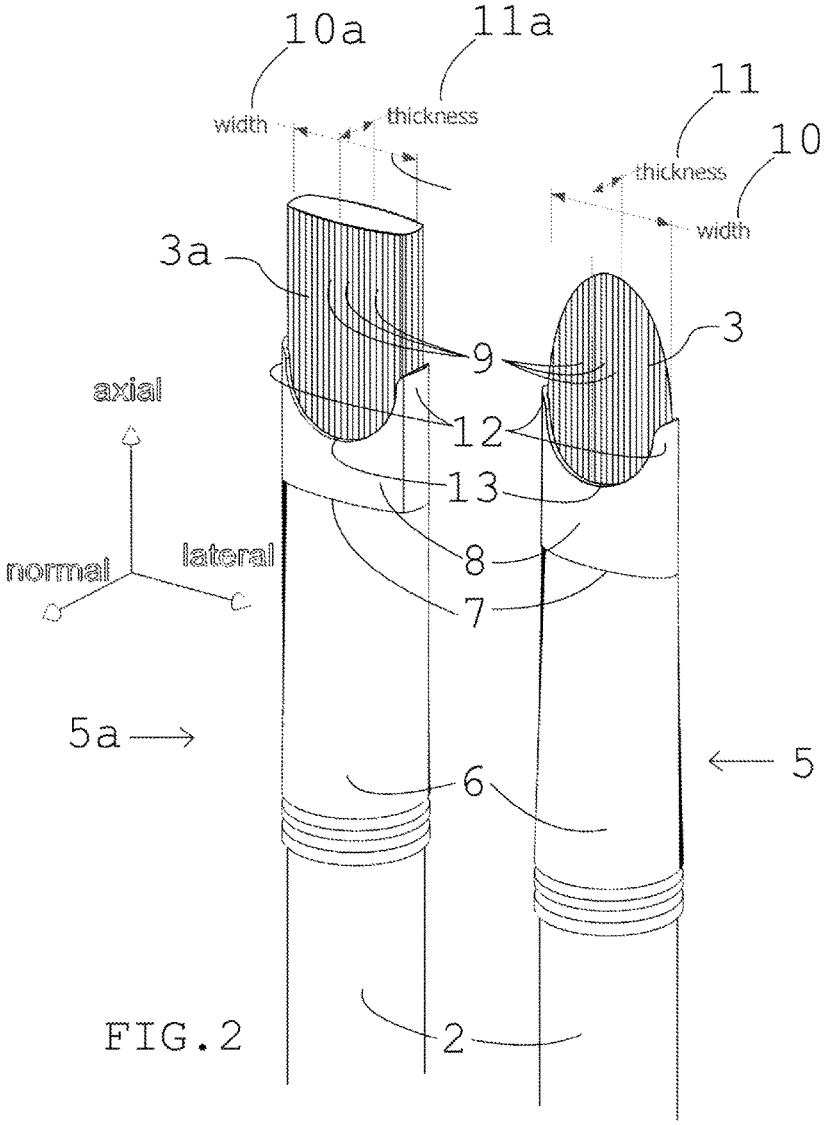
FIG. 2 shows an upright close perspective view of two ferrule and tuft embodiments of a lateral support paintbrush embodiment of the present invention

Referring now to the embodiment shown in FIG. 2, two alternative ferrules and tufts of the present invention are shown, a ferrule (5) similar to that of FIG. 1, which has a tuft (3) that is rounded in shape, and a flat-tuft ferrule (5*a*), which has a flat-tuft (3*a*). Both the ferrules (5 and 5*a*) are exemplary modes, but do not depict all contemplated shapes of the embodiment. Both ferrules (5 and 5*a*) shown comprise 3 regions: a handle region (6), a tuft-engagement region (7), and a bristle control region (8).

Figure 3:
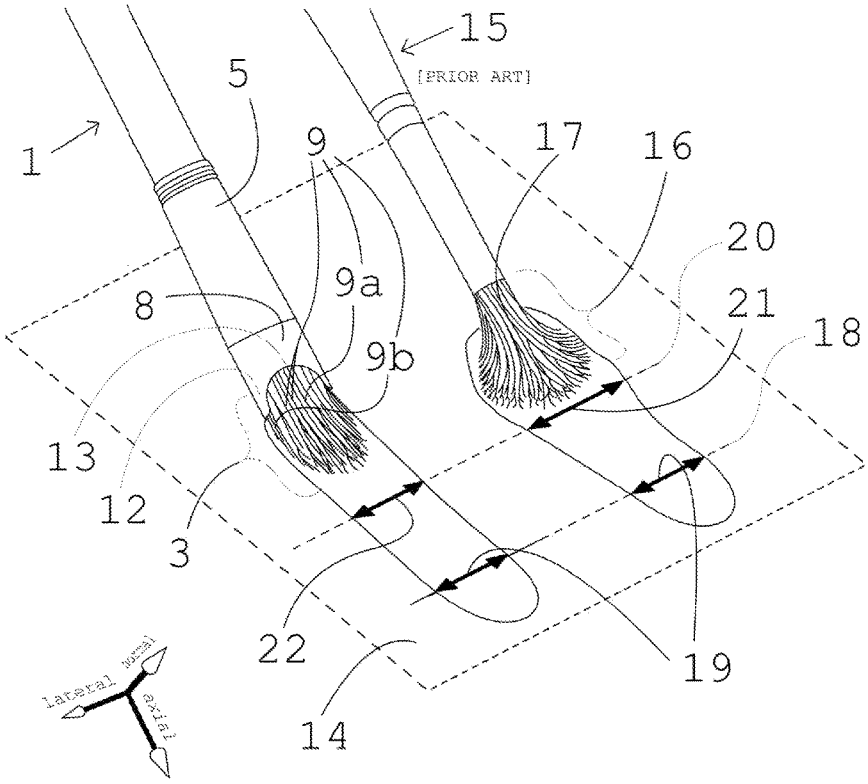
FIG. 3 shows comparative perspective views of splay behavior with respect to a prior art paintbrush and a lateral support paintbrush embodiment of the present invention.

The discussion of dimensions of the present invention are made with reference to the exemplary coordinate system shown in FIGS. 2 and 3, setting lateral, axial and normal axes.

Each ferrule (5 and 5*a*) engage the handle (2) at the handle region (6), which is shown as a crimped structure but which is not limited to crimping, and contemplates alternative methods of concentrically or otherwise joining a circumferential object, such as a ferrule, to a shaft, such as an elongate handle (2). Each ferrule (5 and 5*a*) engages the tuft (3 and 3*a*) at the tuft engagement region (7), thereby connecting handle (2) with the tuft (3 and 3*a*).

In both ferrules (5 and 5*a*), the tuft engagement region (7) is shown as a pinched-fit engagement, wherein the bottom of the tuft (either 3 or 3*a*) is in close proximity to the handle (2) inside the ferrule (respectively 5 or 5*a*), and a pinching step applied to the ferrule (either 5 or 5*a*) that causes the ferrule (either 5 or 5*a*) to take on the shape which is best adapted to a particular tuft (5 with respect to 3, and 5*a* with respect to 3*a*). The pinched-fit engagement therefore creates the tuft engagement region (7) which is the shape which subjectively causes a ferrule (5 or 5*a*) to become adapted to a shape which firmly locates the bottom of its specific tuft (respectively 3 or 3*a*) with respect to the handle (2). The formation of the tuft engagement region (7) by a pinching step is only an exemplary mode, and depiction of merely one method of engaging a tuft is not intended to limit the present invention to solely a pinched-fit.

The third region is a bristle control region (8). The bristle control region (8) provides lateral support for its respective tuft (3,3*a*), to support the bristles (9) of the tuft (3,3*a*) against lateral splaying of the bristles (9) during use.

The tuft (3,3*a*) has a shape with a distinctive width (10, 10*a*) along the lateral axis and a thickness (11, 11*a*) along the normal axis. The bristle control region (8) locates elongated flanges (12) on either side of the width (10,10*a*). The flanges (12) of these ferrules (5, 5*a*) are arcuate in shape and their separated presence on opposite sides of the width (10,10*a*) of the tuft (3,3*a*) render the bristle control region (8) with reciprocally-defined open regions on either side of the thickness (11, 11*a*). The open regions are characterized by their lower profile (13) on either side of the thickness (11, 11*a*) of the tuft (3,3*a*).

The lower profile (13) of the open regions of the bristle control region (8) shown in FIGS. 1-5 is arcuate in shape. While all contemplated embodiments of the invention comprise elongated flanges (12) and lower profiles (13), the arcuate shape of the lower profile (13) depicted in FIGS. 1-5 is merely a preferred embodiment and is not intended to limit the present invention from embodiments comprising elongated flanges (12) and lower profiles (13) of other shapes and defining shapes providing lower profile. One such shape resembles a sinusoidal pattern, when the ferrule (5) is taken about its perimeter, as shown in FIGS. 1-4. A rounded-section cross-cut of the ferrule's diameter, such as might be applied by a "fishmouthing" manufacturing process, can also produce a similarly useful arcuate shape. These are recognized as being only small variations of "arcuate."

Referring now to FIG. 3, what is shown is a comparison of the paint brush splay behavior of two brushes during the course of applying a stroke of paint to a surface (14). The first brush is an embodiment of the present lateral support paintbrush (1) invention having the round-tuft (3) and round-tuft ferrule (5) embodiment shown in FIG. 2. The second brush is a prior art paintbrush (15) also having a round-tuft (16) of bristles (17), which is designed to lay a stroke which is of a width to that which is corresponds to the stroke width produced by the width (10, FIG. 2) of the tuft (3) of the present lateral support paint brush (1). The brushes (1, 15) are shown in parallel, each laying a stroke of paint on the surface (14). At the initiation (18) of the strokes, each brush (1, 15) lays a stroke having the same width (19).

Both painters simultaneously vary pressure at an error position (20), and push enough that the tufts (3, 16) deflect further in the normal direction. As the tuft (16) of the prior art brush (15) deflects, it flattens, and bristles (17) on top of the tuft (16) are pushed toward the surface (14), forcing aside and passing between bristles (17) that were successively closer to the surface (14). With increasing quantity of the bristles (17) pushed aside, the tuft (16) widens in the lateral direction and splays. The splay caused at the error position (20) thereafter results in a significantly wider stroke (21), irritating the artist and potentially ruining the work.

While the event causing splay of the tuft (16) of the prior art paintbrush (15) was compression of the tuft (16) in the normal direction to a degree of excessive deflection, the actual problem was that deflection was capable of causing the error because the bristles (17) had no support against increasing the width of the tuft (16). Without support against lateral deflection, deflection of the bristles (17) in the normal direction simply push ones at the top of the tuft down, and naturally deflect outward, in the lateral direction, the other bristles (17) that were closer to the surface (14).

The present lateral support paintbrush (1) resists splay better at error point 20. As with the prior art tuft (16), compression of the present tuft (3) tends to force bristles (9) into a smaller distance from the surface (14), and attempts to push bristles (9) on the top of the tuft (3) through those which are closer to the surface (14). However, the tuft (3) is supported against deflection in the lateral direction by the elongate flanges (12). With less ability for bristles (9) to deflect laterally, it is harder for bristles (9) at the top of the tuft to deflect down through the tuft (3), and they instead remain substantially at their ordinary, minimally deflected positions offset from the surface (14), relative to the rest of the tuft (3).

What allows for the bristles to not deflect outward where the bristles do extend beyond the flanges (12) in the axial direction is that, as the tuft (3) is deflected by error in the normal direction, the deflection of bristles away from the surface can instead deflect further in the normal direction up through the bristle control region (8), bending away from the axial direction at the lower profile (13).

The specific lower profile (13) shown in FIG. 3 is arcuate, affording the middle bristles (9*a*), ones that are closest to the center of the tuft (9), a very long distance to deflect in the normal direction. Edge bristles (9*b*), ones that are furthest in the lateral direction from the center of the tuft, are located at a position that is parallel in the normal direction to a part of the lower profile (13) which approaches the more enclosing edges of the flanges (12), and are afforded a significantly shorter distance to deflect in the normal direction. As a result, when the tuft (3) is compressed in the normal direction, such as when the middle bristles (9*a*) deflect in the normal direction, bristles (9) which are relatively close to middle of the tuft (3) can deflect toward the center of the tuft (3), to be carried upward between middle bristles (9*a*).

With these provisions for deflection to resist in-use splay, the stroke width (22) of the tuft (3) at the error position (20) remains approximately the same width (19) as the width of the stroke (19) at the initiation (18) of the stroke.

Figure 4:
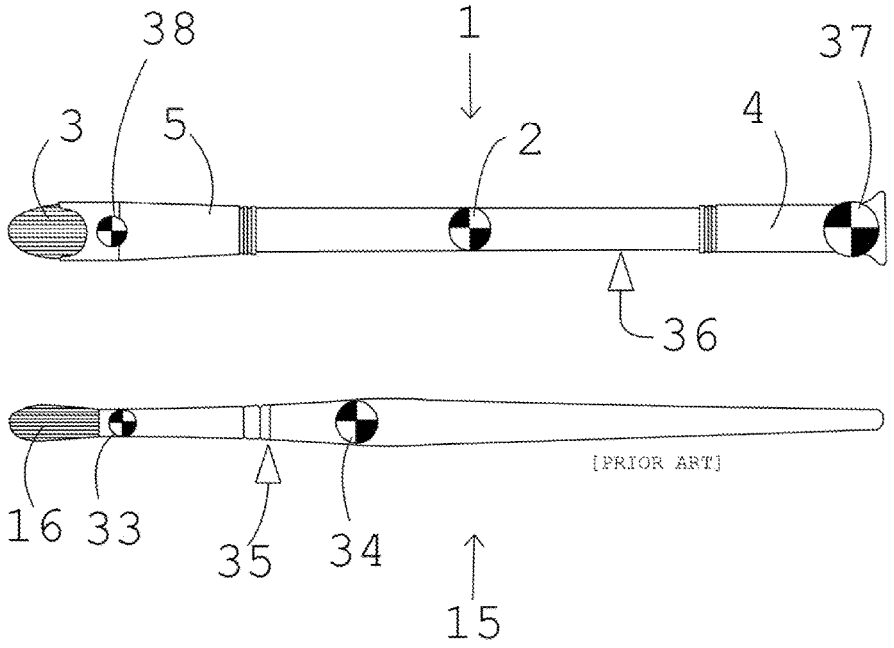
FIG. 4 shows a comparative side views of a prior art paintbrush and a counterbalanced lateral support paintbrush embodiment of the present invention

Referring now to FIG. 4, a counterbalanced lateral support paintbrush (1) is shown with respect to a prior art paint brush (15) for purposes of showing improvement of the location of the equilibrium point of said lateral support paintbrush (1). Discussed elements have centers of gravity indicated in estimated positions. The prior art paint brush (15) generally consists of two masses, its tuft-ferrule combination as a single element (33), and its handle (34).

The net equilibrium point (35) of the prior art paint brush (15) occurs at a weight-biased position between the two elements, closer to the end proximate to the enlarged region of the handle (34), but still substantially close to the ferrule-tuft combination (33), relative to the overall length of the brush (15). The equilibrium point (35) is very far forward relative to the overall length of the brush (15), and is not optimal for painters whose work weighs in favor of a more central grip, such grip being generally rearward of most brushes of the prior art.

A more-rearward grip of a brush such as the prior art brush (15) would effect a resistance to changes of motion about the painter's hand that is proportional to the distance between the very far forward equilibrium point (35) and the center of the painter's grip. Continuous grip against the resistance causes fatigue of the painter's hand. Fatigue of the hand makes painting more difficult and can irritate the artist, if not also make for poor or ruined artwork. Fatigue also plays a potential role in causing splay, as it results in earlier onset of degradation of the ability to maintain consistency of applying optimal pressure along the length of a stroke. Variation of pressure may result in deflection of the tuft (16), which is one source of splay discussed with respect to FIG. 3.

The lateral support paintbrush (1) is better adapted to resist fatigue, because it provides a brush with an equilibrium point (36) that lies in the middle third of the overall length of the brush (1), much closer to the rear of the lateral support brush (1), compared to the equilibrium point (35) of the prior art brush (15). It achieves the better-located equilibrium point (36) by providing a counterbalancing weight (4) having a significantly rearward center of gravity (37), counterbalancing weight (4) being applied to the end of the handle (2) which is opposite the end at which the ferrule (5) is applied to the handle (2) of the lateral support paintbrush (1).

The counterbalancing weight (4) is adapted to balance the significant forward mass (38) of the combined ferrule (5) and tuft (3) of the lateral support paintbrush (1). The lateral support paintbrush (1) shown has a handle (2) that is dowel-like, generally having a consistent cross-section along its length. Therefore, it has a center of gravity approximately at its halfway point, along its length. The handle (34) of the prior art brush (15) is tapered, having a much larger cross-section at its front-end, and has a center of gravity much closer toward its front end. The comparatively rearward center of gravity of the handle (2) of the lateral support paintbrush (1), as compared to the handle (34) of the prior art paintbrush (15), also assists the rearward shift of the equilibrium point (36).

Figure 5:
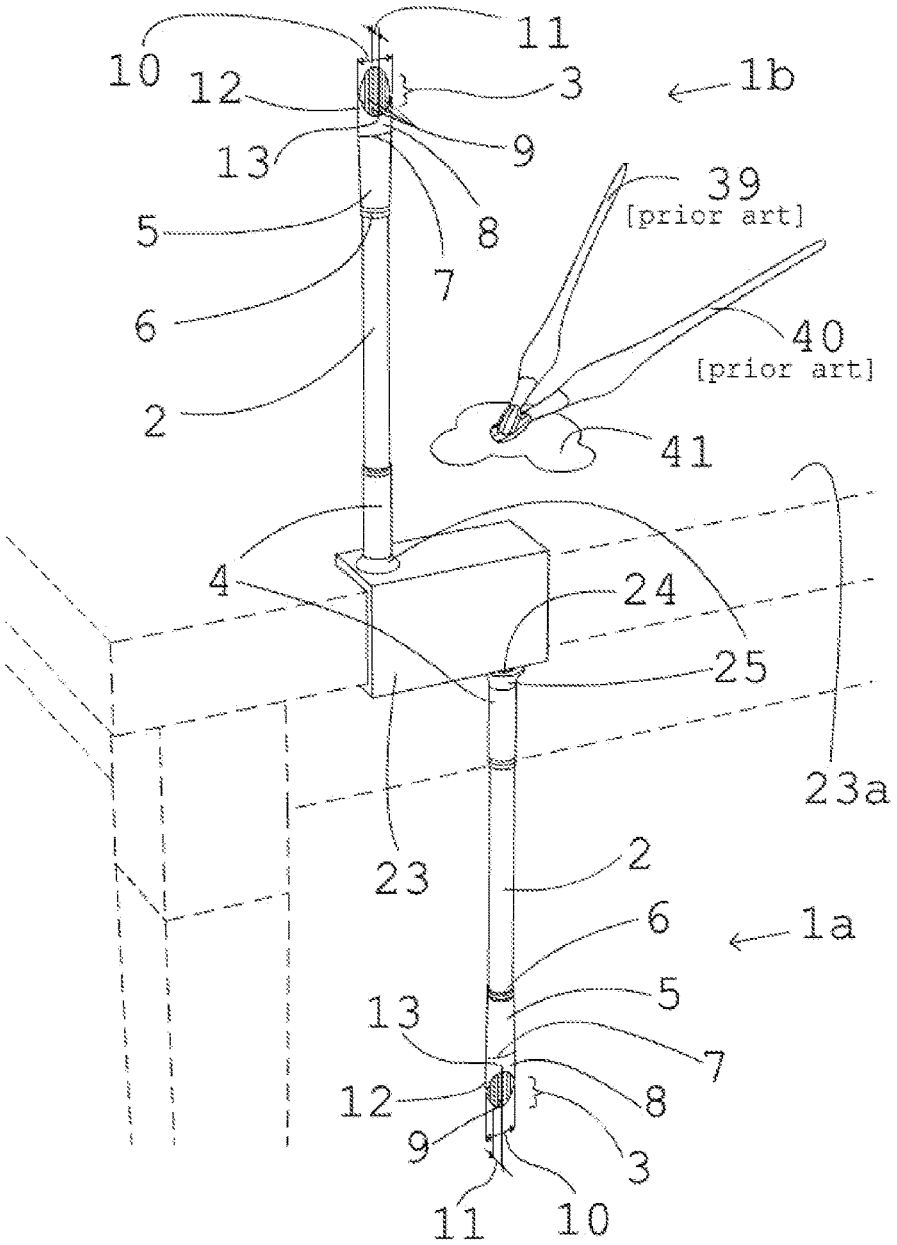
FIG. 5 shows upright and hanging retainment arrangements of a magnetic counterbalanced paintbrush embodiment of the present invention.

Referring now to FIG. 5, two counterbalanced lateral support paintbrushes (1*a* and 1*b*) are shown magnetically retained to a magnetic object (23) or a convenient surface (23*a*) and substantially perpendicular to a convenient surface (23) that is substantially perpendicular to gravity. The first lateral support paintbrush (1*a*) is shown hanging from a magnetic object (23), and the second lateral support paintbrush (1*b*) is shown standing atop the surface of a magnetic object (23). Both brushes comprise a weighted counterweight (4) that comprises a magnetic element (24, visible on 1*a*) and a flared foot (25). For purposes of hanging, the attractive force between the magnetic element (24) of the first brush (1*a*) and the magnetic object (23) is sufficient to hold at least the entire weight of the brush (1*a*) to the magnetic object. For purposes of standing, the attractive force between the magnetic element (24) and the magnetic object (23) is sufficient to hold the brush (1*b*) upright and resist moderate tipping forces.

In a contemplated embodiment, the attractive force between the magnetic element (24) and a magnetic object (23), when the attractive force is applied about the edge of the foot (25), may only be sufficient adequate to facilitate an increase of ordinary geometric stability to self-right while not being so great as to make retrieval of the brush irritably effortful and which minimizes the potential of a cumulative lifetime effect of tugging the counterbalance (4) out of position with respect to either brush (1*a*, 1*b*).

In both hanging and standing positions, the tuft (3) is symmetrically aligned with gravity, and allows either brush (1*a*, 1*b*) to be set down and minimally occupy space and not suffer detrimental effects of laying horizontally on a convenient surface (23*a*). Some detrimental effects of laying horizontally include inadvertent paint mixing, transfer of paint between brushes, or paint deposition upon a surface (such as 23*a*), or an object (such as 23, or any other object) intended to be free of paint, or even dry with paint retained, causing splay. Because a brush laying horizontally may place its tuft in contact with a surface (such as 23*a*), or may have paint retained within the tuft (3) sink toward the part of the tuft (3) which is closest to the convenient surface (23*a*), splay resulting from horizontal laying is also more likely to result in splay that is asymmetric with respect to the center of the tuft (3). A brush (1) which splays asymmetrically may result in a brush (1) whose effective stroke was offset with respect to the center of its tuft (3).

FIG. 5 also shows two paintbrushes (39, 40) of the prior art, dripping paint (41) onto the table (23*a*). As one prior art paintbrush (39) is touching the other prior paintbrush (40), paint on the first paintbrush (39) is being transferred to the second paintbrush (40), and vice-versa. As both paintbrushes (39, 40) are laying in the same paint (41), on the surface (23*a*), they are also receiving paint (41) from the surface (23*a*), regardless of whether the first brush (39), or the second brush (40), or another object was the source of the paint (41). Comparatively, both tufts (3) of each of the vertically standing paintbrush (1*b*), and vertically hanging paintbrush (1*a*), are held away from the paint (41) on the surface (23*a*), and also do not touch either of the prior art paintbrushes (39, 40), so it is not possible for either of the tufts (3) to communicate paint to or from any of the paintbrushes (39, 40) or surface (23*a*).

Hanging the lateral support paintbrush (1*a*) is useful to dry out the tuft (3) more evenly. After rinsing out excess paint from the tuft (3), inversion of the brush (1*a*) orients the bristles (9) parallel to gravity. In this position, any paint which was not rinsed out of the tuft (3) stands the greatest chance of exiting in a manner that resists splaying, because it allows for the greatest opportunity to drain-off paint that might otherwise dry on the bristles (9) and cause splay. As water or paint and other material retained between the bristles (9) escapes from the tuft (3), the bristles (9) are able to return toward their original alignment, and closer to parallel to one another.

The magnetic retainment from a magnetic object (23) inherently positions the brush (1*a*) under either the magnetic object (23), or under a convenient surface (23*a*) comprising a magnetic object (23). As a result, the top face of the convenient surface (23*a*) is left vacant, paint (41) drips which might be deposited upon the convenient surface (23*a*), such as by dripping from the tuft (3), are averted, and such a paint brush (1*a*) can then be readily available to the painter but not necessarily being in plain view.

Standing the lateral support paintbrush (1*b*) is useful for depositing the paint brush (1*b*) for retainment on a convenient surface (23*a*) mid-painting, allows multiple brushes to more easily be available vertically atop a convenient surface (23*a*), as opposed to having a quantity of brushes (multiple instances of 1*a*) hanging under an object (for example, 23, or under surface 23*a*) whose accessible magnetic surface area is smaller than its top surface, such as the circumstance of a magnetic object (23) being positioned to the top a table (such as a convenient surface (23*a*)). Also, when standing, such brushes (1*b*) might better retain paint for purposes of not wasting paint by having it drip off or for purposes of avoiding the risk of depositing paint (41) on a surface (23*a*) intended to be free of paint (41), such as a floor, or the painter himself, such as in the case of said object being located in a place above the painter when creating a piece of work.

Figure 6:
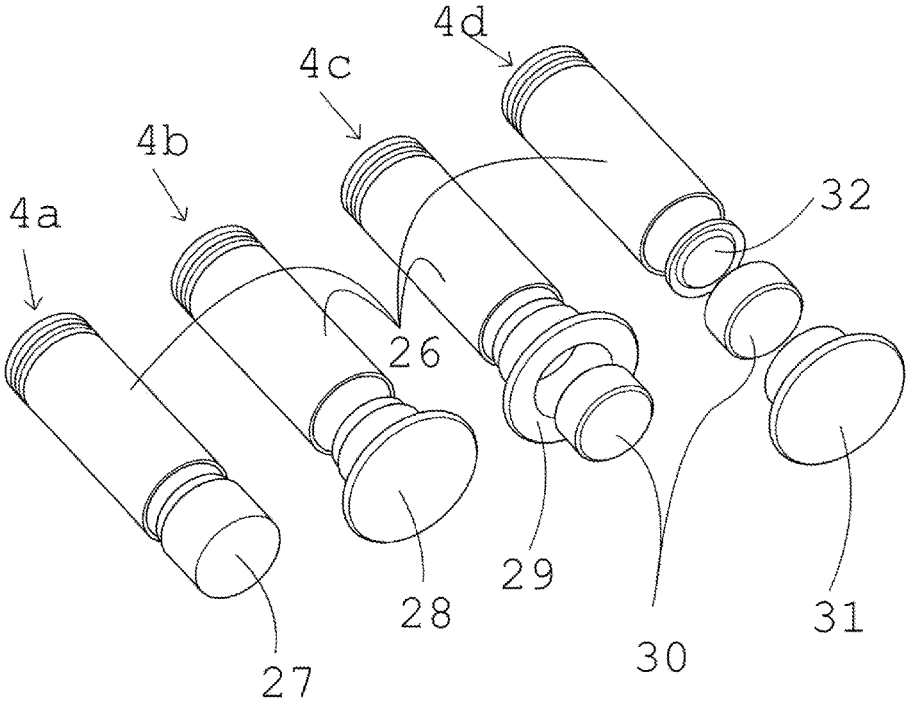
FIG. 6 shows four alternative embodiments of construction of counterbalancing weights of the present counterbalanced lateral support paintbrush embodiment of the present invention.

In FIGS. 1 and 4, a counterbalancing weight (4) is depicted. FIGS. 1 and 4 do not describe any alternative embodiments for the counterbalancing weight (4) that are not one piece. Referring now to FIG. 6, 4 alternative embodiments of a counterbalancing weight (4*a*, 4*b*, 4*c*, 4*d*) are shown. Each of the alternative embodiments comprises a separate weight-ferrule-body (26) that is adapted to engage the handle (2, FIGS. 1, 4, 5). in a manner that is analogous to the circumferential engagement of the handle engaging region (6) of the ferrule (5) embodiments shown in FIGS. 1-5. A preferred embodiment of the weight-ferrule-body (26) comprises a concentric cylindrical tube which is adapted to be crimped to the handle (2) of FIGS. 1-5. The tube is not intended to limit the construction of the weight-ferrule-body (26), and other variations of connecting a ferrule to a handle known in the art are contemplated as embodiments of the present lateral support brush (1) invention. The best mode of the lateral support paintbrush (1) would comprise a dowel-like handle (2) that has a consistent cross-section along its length.

The first counterbalancing weight (4*a*) is a two piece arrangement comprising a separate weight element (27) which does not comprise a flared foot. Even without a flared foot, the weight element (27) still provides a counterbalancing weight (4) sufficient to move the equilibrium point (36, FIG. 4) to provide the fatigue-minimizing benefits described with respect to FIG. 4. It may additionally provide magnetic retainment sufficient to hang a lateral support paintbrush (1*a*, FIGS. 1-5), since magnetic retainment for hanging does not require a flared foot, to provide the hanging vertical benefits described with respect to the hanging lateral support paintbrush (1*a*, FIG. 5).

The second counterbalancing weight (4*b*) is a two piece arrangement that comprises a separate weight element (28) that is both magnetic and which provides a flared foot (28) to the ferrule body (26). This counterbalancing weight embodiment (4*b*) is adequate to provide the counterbalance (4) of the second lateral support brush (1*b*) that is shown standing up in FIG. 5. It is contemplated as an embodiment which provides all of the benefits of counterbalance, magnetic standing and magnetic hanging, and which also comprises the advantages of requiring the manufacture of only one component or providing consistency that may come from manufacture of a single element.

The third counterbalancing weight (4*c*) is a three piece arrangement which provides all of the benefits of counterbalance, magnetic standing and magnetic hanging, but which provides a weight element comprising a separate flared foot element 29 and a dedicated magnetic element (30). This counterbalancing weight embodiment (4*c*) is adequate to provide the counterbalance (4) of either of the lateral support brushes (1*a*, 1*b*) shown in FIG. 5. It is contemplated as an embodiment which may afford greater and earlier quality and performance by independently accessing quality assurances available in existing generic magnets to provide adequate function for a dedicated magnetic element (30).

The fourth counterbalancing weight (4*d*) is a four piece arrangement which provides all of the benefits of counterbalance, magnetic standing and magnetic hanging, but which differs from the third counterbalancing weight (4*c*) by providing a dedicated magnetic element (30) that is retained internally within a flared foot (31), to provide the significant lifetime benefit of decreased risk of the magnetic element (30) eventually detaching, such as might be caused by cumulative use of the magnetic element (30) for retainment of the lateral support paintbrush (1) to a convenient surface (23*a*). This counterbalancing weight embodiment (4*c*) is adequate to provide the counterbalance (4) of either of the lateral support brushes (1*a*, 1*b*) shown in FIG. 5.

Like the third embodiment (4*c*), the fourth embodiment (4*d*) is contemplated as an embodiment which may afford greater and earlier quality and performance by independently accessing the quality assurances available in existing generic magnets to provide adequate function for a dedicated magnetic element (30). The fourth piece of this embodiment (4*d*) is an internal cap (32) that is contemplated as part of the embodiment which may be used to at least retain the dedicated magnetic element (30) within the flared foot (31) and perhaps additionally function to increase the strength of retainment of the flared foot (31) within the weight-ferrule-body (26).

All of the embodiments (4*a*, 4*b*, 4*c*, 4*d*) for a counterbalancing weight (4) disclosed with respect to FIG. 6 contemplate affixing all disclosed components with respect to the weight-ferrule-body (26) by any method sufficient to affix the recited separate elements (27, 28, 29, 30, 31, 32) thereon.

I claim:

1. A brush, comprising:

a. an elongate handle, having a first end and a second end;

b. a tuft of bristles comprising orthogonal directions: an axial direction parallel to said handle, a lateral direction and a normal direction having a proximal section and a distal section, c. a ferrule adapted to connect said tuft to said handle comprising a handle region, a tuft engagement region and a bristle control region:

i. said handle region constructed and arranged to connect to the first end of said handle; and ii. said tuft engagement region constructed and arranged to receive the proximal section of said tuft to attach said tuft to said brush; and iii. said bristle control region constructed and arranged such that the distal section of the tuft extends outwardly from said bristle control region, said bristles forming a paint application section of the brush, said bristles being oriented substantially parallel to said axial direction when the bristles are not under pressure; and iv. flanges positioned on opposite sides of the bristle control region most distal from the tuft engagement region, said flanges having a preselected width and being oriented in the normal direction, and further wherein the bristle control region includes a cut-out area proximate the respective flanges that extend toward the tuft engagement region between the respective flanges in the lateral direction, said flanges being higher than the cut-out area;

i.

d. whereby when said brush is applied under pressure to a surface said tuft is supported in the lateral direction and permitted to move in the normal direction thereby preventing bristle splaying.

2. The brush of claim 1, wherein said cut-outs are arcuate in shape, the ends of said arc terminating proximate the flanges.

3. The brush according to claim 1, and further:

a. comprising a weight operatively associated with the second end of said handle.

4. The brush according to claim 3, wherein said weight:

a. approximately counterbalances the weight of the ferrule, bristles and paint or other brushable material retained within the tuft, such that i. the center of gravity of said brush lies in the middle third of said handle.

5. The brush according to claim 3, wherein said weight is magnetic;

a. whereby the brush may be magnetically attached to a surface and hang therefrom.

6. The brush according to claim 3, wherein said weight is selectively attachable to said handle.

7. The brush according to claim 6, wherein said weight is selectively attachable to said handle by being configured and arranged to selectively engage with paint brush geometry.

8. The brush according to claim 7, wherein the elongate handle has handle geometry with is dowel-like.

9. The brush according to claim 6, wherein the elongate handle has handle geometry which has a substantially consistent cross-section shape between said first end and said second end.

10. The brush according to claim 3, wherein said weight is magnetic; and wherein said weight comprises a flared foot providing stability in an arrangement of the brush with respect to a surface, one selected from a list comprising at least: hanging, standing and significant angular offset from parallel to a surface.

* * * * *